United States Patent [19]

McCandless

[11] Patent Number: 4,633,130

[45] Date of Patent: Dec. 30, 1986

[54] MULTIBEAM ELECTRON GUN HAVING A TRANSITION MEMBER AND METHOD FOR ASSEMBLING THE ELECTRON GUN

[75] Inventor: Harry E. McCandless, Manor Township, Lancaster County, Pa.

[73] Assignee: RCA Corporation, Princeton, N.J.

[21] Appl. No.: 735,261

[22] Filed: May 17, 1985

[51] Int. Cl.[4] ..... H01J 29/50

[52] U.S. Cl. ..... 313/417; 313/456; 445/36; 228/124; 228/159

[58] Field of Search ..... 313/417, 446, 451, 456; 228/124, 159, 160

[56] References Cited

U.S. PATENT DOCUMENTS

| | | | |
|---|---|---|---|
| 3,302,961 | 2/1967 | Franklin | 228/124 X |
| 3,551,997 | 1/1971 | Etter | 228/124 |
| 3,983,446 | 9/1976 | Miram et al. | 313/452 |
| 4,298,818 | 11/1981 | McCandless | 313/417 |
| 4,331,740 | 5/1982 | Burns | 428/572 |
| 4,338,380 | 7/1982 | Erickson et al. | 228/124 |
| 4,486,948 | 12/1984 | Chiba et al. | 29/827 |
| 4,500,808 | 2/1985 | McCandless | 313/409 |
| 4,500,809 | 2/1985 | Odenthal et al. | 313/444 |
| 4,558,254 | 12/1985 | Opresko | 313/270 |

FOREIGN PATENT DOCUMENTS

| | | | |
|---|---|---|---|
| 1022432 | 3/1966 | United Kingdom | 228/124 |

OTHER PUBLICATIONS

U.S. patent application Ser. No. 643,175, filed on Aug. 22, 1984, by H. E. McCandless et al. and entitled, "Multibeam Electron Gun Having a Cathode-Grid Subassembly and Method of Assembling Same", RCA 80,211, not enclosed.

U.S. patent application Ser. No. 643,314, filed on Aug. 22, 1984, by S. T. Villanyi and entitled, "Structure for and Method of Aligning Beam-Defining Apertures by Means of Alignment Apertures", RCA 80,130, not enclosed.

*Primary Examiner*—Stewart J. Levy
*Assistant Examiner*—Hezron E. Williams
*Attorney, Agent, or Firm*—Eugene M. Whitacre; Dennis H. Irlbeck; Vincent J. Coughlin, Jr.

[57] ABSTRACT

The novel electron gun comprises, as in prior guns, a plurality of cathode assemblies and at least two spaced successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. Unlike prior guns, a first transition member is attached to the metallized pattern on the first major surface. At least one of the electrodes is attached to the first transition member.

10 Claims, 8 Drawing Figures

MULTIBEAM ELECTRON GUN HAVING A TRANSITION MEMBER AND METHOD FOR ASSEMBLING THE ELECTRON GUN

BACKGROUND OF THE INVENTION

The present invention relates to a novel multibeam electron gun and a novel method for assembling that gun. The novel gun and novel method can provide better alignment of successive grid apertures, better control of spacing between successive grid electrodes and a reduction in electron gun distortion as compared with prior gun designs.

U.S. Pat. No. 4,298,818, issued Nov. 3, 1981, describes an electron gun for use in a multibeam cathode-ray tube. The gun includes at least two spaced successive electrodes brazed directly to metallized patterns on one surface of a ceramic support and a plurality of cathode support assemblies brazed directly to metallized patterns on the opposite surface of the ceramic support. Each electrode comprises a single metal plate having three beam-defining apertures therethrough, which apertures are so aligned as to permit the passage of three electron beams. The sizes and shapes of the electron beams are determined, in part, by the sizes, shapes and alignments of the apertures. Apertures that are misaligned by as little as 0.0125 mm (0.5 mil) can cause distorted beam shapes and degrade the performance of the tube.

U.S. Pat. No. 4,500,808, issued Feb. 19, 1985, describes an improved electron gun similar to that of U.S. Pat. No. 4,298,818 except that the second electrode comprises a composite structure having a metal support plate brazed directly to a metallized pattern on one surface of a ceramic support. The metal support plate has a window therein opposite each of the apertures in a first electrode which is also brazed directly to a separate metallized pattern on the same surface of the ceramic support. Separate metal plates are brazed to the metal support plate and close the windows therein. Each of the metal plates has a single electron beam-defining aperture therein which is separately aligned with one of the apertures in the first electrode. This structure provides more accurate alignment of successive grid apertures than previous structures.

In each of the above-described electron guns, the successive electrodes and the cathode support assemblies are simultaneously brazed directly to metallized patterns formed on the ceramic support. This simultaneous brazing process has several drawbacks, some of which include: the difficulty of adjusting the spacing between successive electrodes; the difficulty of removing the completed assembly from the brazing fixture; dirt in the brazing fixture can effect alignment of the apertures; forming the electrode contact leads can change the spacing between the electrodes and, most importantly, the brazing operation frequently distorts the metal parts and imparts stress into the ceramic support which can crack the ceramic support. As a result, a structure and assembly process are required which reduce or eliminate the drawbacks of the prior art.

SUMMARY OF THE INVENTION

The novel electron gun comprises, as in prior guns, a plurality of cathode assemblies and at least two spaced successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. Unlike prior guns, a first transition member is attached to the metallized pattern on the first major surface. At least one of the electrodes is attached to the first transition member.

The novel method includes brazing only the transition member to the metallized pattern on the ceramic member. The transition member, which includes a plurality of electrode contact portions and a removable frame portion connected to the electrode contact portions by at least one weakened bridge region, has the frame portion removed to provide a plurality of electrically isolated electrical contact portions. The successive electrodes are individually aligned and attached to the individual contact portions of the transition member.

DETAILED DESCRIPTION OF THE PREFERRED EMBODIMENTS

Figure 1:
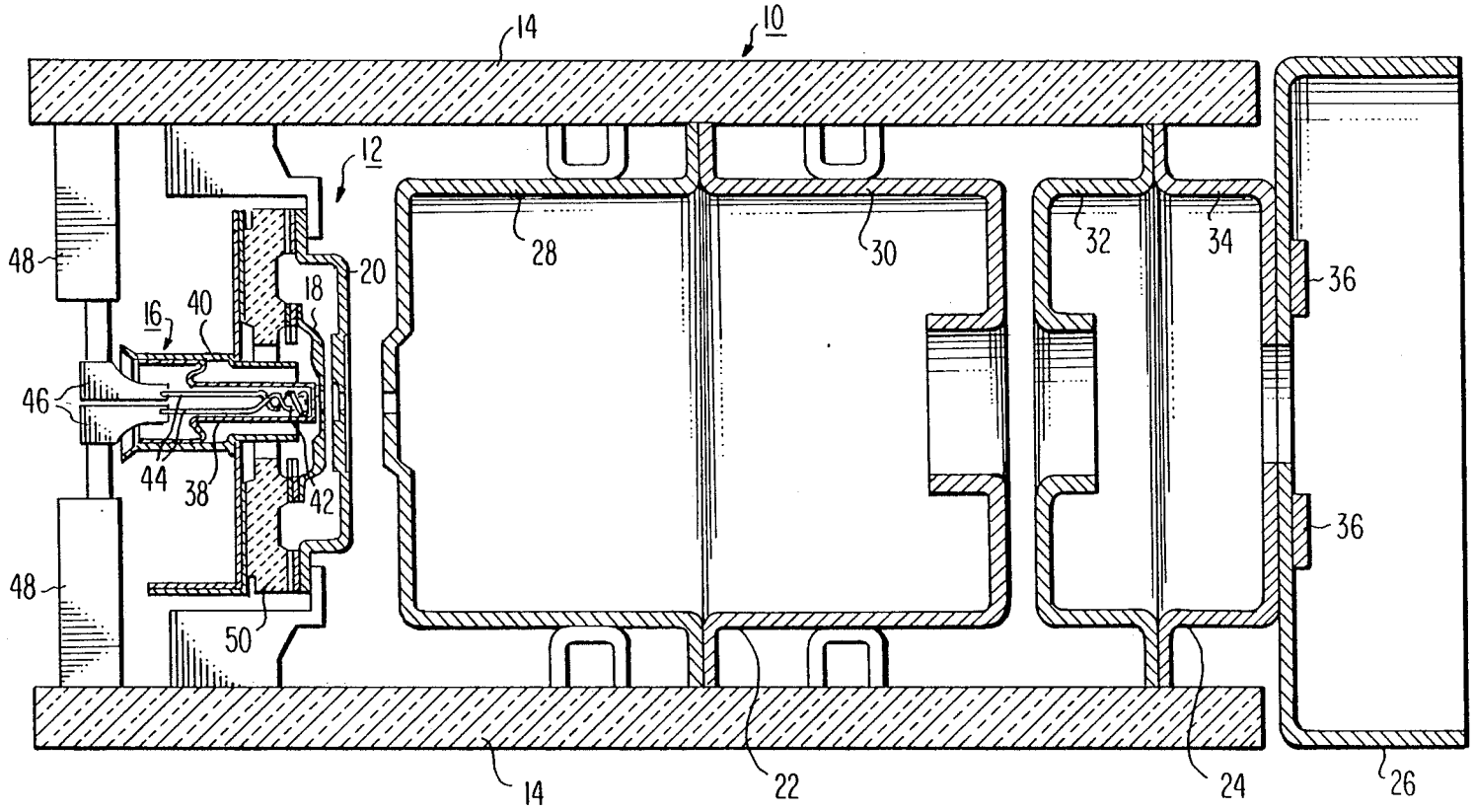
FIG. 1 is a partially cut-away, side elevational view of a preferred embodiment of the novel electron gun.

As shown in FIG. 1, an improved electron gun 10 includes a novel cathode-grid subassembly 12. The improved gun 10 is similar to the gun disclosed in U.S. Pat. No. 4,500,808, except for the novel cathode-grid subassembly 12 and the method of fabricating the subassembly with these electrodes. The gun 10 comprises two glass support rods 14, also called beads, upon which various electrodes of the gun are mounted. These electrodes include three equally-spaced inline cathode assemblies 16, one for each electron beam (only one of which is shown in the view in FIG. 1), a control grid electrode 18, a screen grid electrode 20, a first focusing electrode 22, a second focusing electrode 24 and a shield cup 26 spaced from the cathode assemblies in the order named.

The first focusing electrode 22 comprises a substantially rectangularly cup-shaped lower first member 28 and a similarly shaped upper first member 30 joined together at their open ends. The closed ends of the members 28 and 30 have three apertures therethrough, although only the center apertures are shown in FIG. 1. The apertures in the first focusing electrode 22 are aligned with the apertures in the control and screen grid electrodes 18 and 20. The second focusing electrode 24 also comprises two rectangularly cup-shaped members, including a lower second member 32 and an upper second member 34 joined together at their open ends. Three inline apertures also are formed in the closed ends of the upper and lower second members 32 and 34, respectively. The center apertures in the upper and lower second members 32 and 34 are aligned with the center apertures in the other electrodes; however, the two outer apertures (not shown) in the second focusing electrode 24 are slightly offset outwardly with respect to the two outer apertures in the first focusing electrode 22 to aid in convergence of the outer beams with the center beam. The shield cup 26, located at the output end of the gun 10, has appropriate coma correction members 36 located on its base around or near the electron beam paths, as is known in the art.

Each of the cathode assemblies 16 comprises a substantially cylindrical cathode sleeve 38 closed at the forward end and having an electron emissive coating (not shown) thereon. The cathode sleeve 38 is supported at its open end within a cathode eyelet 40. A heater coil 42 is positioned within the sleeve 38 in order to indirectly heat the electron emissive coating. The heater coil 42 has a pair of legs 44 which are welded to heater straps 46 which, in turn, are welded to support studs 48 that are embedded in the glass support rods 14.

Figure 2:
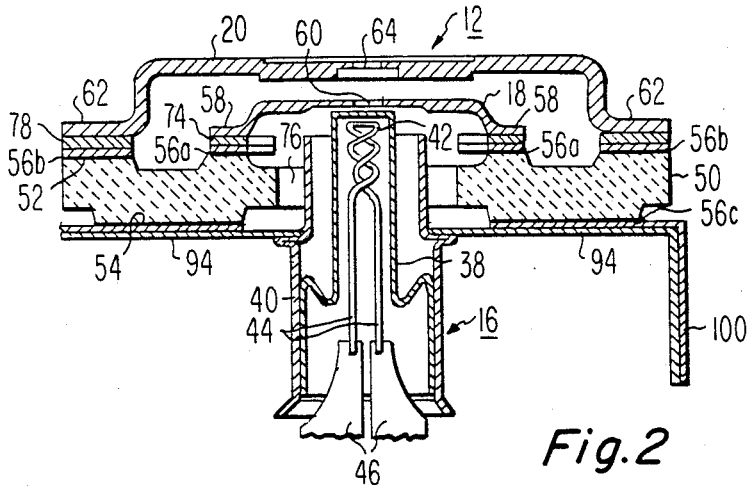
FIG. 2 is an enlarged side elevational view of a cathode-grid subassembly of the novel electron gun of FIG. 1.

The cathode-grid subassembly, shown in detail in FIG. 2, includes a ceramic member 50, having an alumina content of about 99%, to which the cathode subassemblies 16 and the control grid and screen grid electrodes 18 and 20, respectively, are attached. The ceramic member 50 includes a first major surface 52 and an oppositely disposed substantially parallel second major surface 54. The ceramic member has a thickness of about 1.5 mm (0.060 inch). At least a portion of the first major surface 52 has metallizing patterns **56*a* and 56*b* formed thereon to permit attachment thereto of the electrodes 18 and 20, respectively. A plurality of electrically isolated metallizing patterns (only one of which, 56*c*, is shown) are provided on the second major surface 54 to permit attachment of the cathode assemblies 16 thereto. The metallizing of a ceramic member is well known in the art and needs no further explanation. The major surfaces 52 and 54 may include lands, as shown in FIG. 2, which facilitate application of the metallizing patterns thereto. The control grid electrode 18 is essentially a flat plate having two parallel flanges 58 on opposite sides of the three inline, precisely spaced, beam-defining first apertures 60, only one of which is shown. The screen grid electrode 20 is also essentially a single flat metal plate having two parallel flanges 62 on opposite sides of three inline, precisely spaced, beam-defining second apertures 64**, only one of which is shown. Alternatively, the screen grid electrode may comprise a composite structure, as described in U.S. Pat. No. 4,500,808.

In U.S. Pat. No. 4,500,808, in copending U.S. patent application Ser. No. 643,175, filed on Aug. 22, 1984, by McCandless et al., and in U.S. patent application Ser. No. 643,314, filed on Aug. 22, 1984, by Villanyi, control and screen grid electrodes and portions of the cathode assemblies are brazed directly to the metallized patterns on the ceramic surfaces. The brazing of a plurality of formed metal parts tends to distort at least some of the parts and introduce stress into the ceramic member. If the stress is sufficiently great, the ceramic member will crack, rendering the cathode-grid subassembly unusable.

In the present novel structure, the distortion of the formed metal parts, including the control grid 18 and the screen grid 20, is eliminated by providing, as shown in FIGS. 2–5, a substantially flat bimetal transition member 66 which is brazed to the firsr major surface 52 of the ceramic member 50. A substantially flat second bimetal transition member 68, shown in FIGS. 6 and 7, is brazed to the second major surface 54 of the ceramic member 50.

Figure 3:
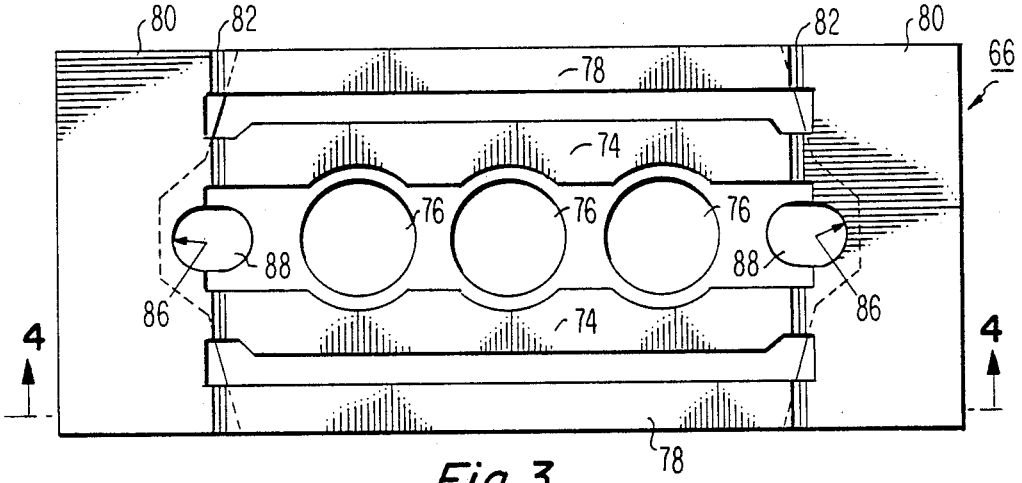
FIGS. 3 and 4 are an enlarged plan view and an enlarged side sectional view, respectively, of a portion of the cathode-grid subassembly during its manufacture.
Figure 4:
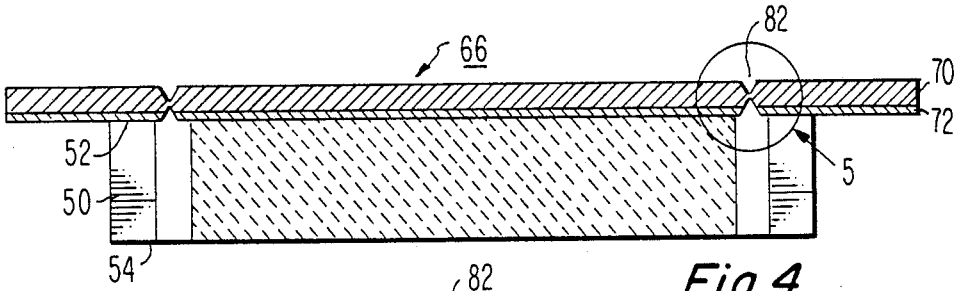

With reference to FIGS. 2–5, the first bimetal transition member 66 is shown disposed on the first major surface 52 of the ceramic member 50. The transition member 66 includes two layers of metal bonded face-to-face to form a bimetal. The first metal layer 70 is preferably formed from a nickel-iron alloy of 42% nickel and 58% iron, having a thickness of about 0.2 mm (0.008 inch), which is not greater than about 20% of the thickness of the ceramic member 50, and the second metal layer 72 is preferably formed of copper, having a thickness of about 0.025 mm (0.001 inch). The melting point of the copper layer 72 is about 1083° C., and the melting point of the nickel-iron alloy layer 70 is about 1427° C., which is substantially higher than that of the copper. The first transition member is stamped or photo-etched and thereby configured to conform to the shape of the metallizing patterns **56*a* and 56*b* on the first major surface 52 of the ceramic 50. The second metal layer 72 is disposed on the first major surface 52. As shown in FIG. 3, the first transition member 66 includes first electrode contact portions 74 disposed above and below a trio of large inline apertures 76 in the ceramic member 50, and second electrode contact portions 78 spaced from the first electrode contact portions 74. A pair of oppositely disposed removable frame portions 80 are connected to the electrode contact portions 74 and 78 by weakened bridge regions 82 which comprise oppositely disposed notches 84 formed in the first metal layer 70. A pair of oppositely disposed, arcuately shaped alignment channels 86 are formed in the bridge regions 82. The alignment channels are aligned, in a manner to be described hereinafter, with corresponding alignment apertures 88 in the ceramic member 50 to register the first electrode contact portions 74 and the second electrode contact portions 78 with the first and second major surface metallizing patterns 56*a* and 56*b***, respectively.

Figure 6:
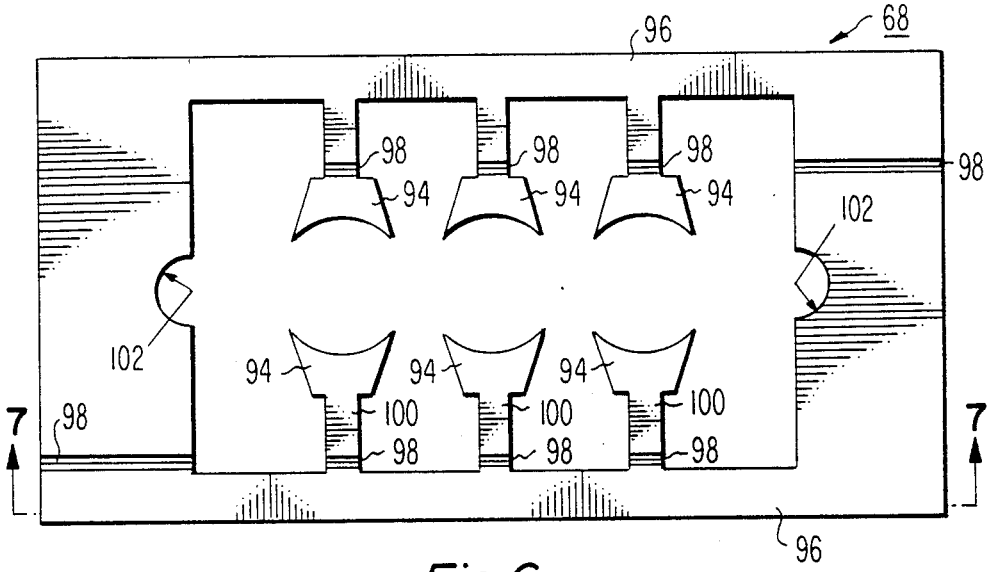
FIGS. 6 and 7 are an enlarged plan view and a side sectional view of a transition member according to the present invention.
Figure 7:
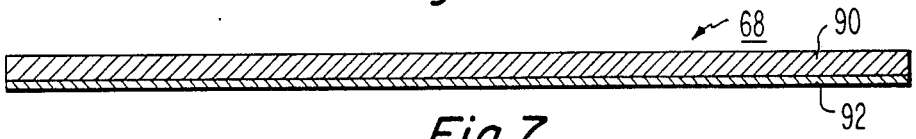

The second bimetal transition member 68, shown in FIGS. 2, 6 and 7, also includes two layers of metal bonded face-to-face to form a bimetal. The first metal layer 90 is preferably formed of the above-described nickel-iron alloy and has a thickness of about 0.2 mm (0.008 inch), and the second metal layer 92 is preferably formed of copper and has a thickness of about 0.025 mm (0.001 inch). The second transition member 68 is stamped or photo-etched to conform to the shape of the metallizing patterns **56*c* on the second major surface 54 of the ceramic member 50. During fabrication of the cathode-grid subassembly 12, the second metal layer 92, comprising copper, is disposed on the second major surface 54. The second transition member includes three pairs of cathode assembly contact portions 94, and a pair of removable frame portions 96 which are connected to the cathode assembly contact portions 94 by weakened bridge regions 98. The bridge regions are configured to provide integral cathode contact leads 100 on one side of the cathode assembly contact portions 94. A pair of oppositely disposed, arcuately shaped second transition member alignment channels 102 are formed in the removable frame portions 96 to facilitate alignment of the channels 102 with the alignment apertures 88 in the ceramic member 50 to register the cathode assembly contact portions 94 with the metallizing patterns 56c formed on the second major surface 54 of the ceramic member 50**.

Figure 8:
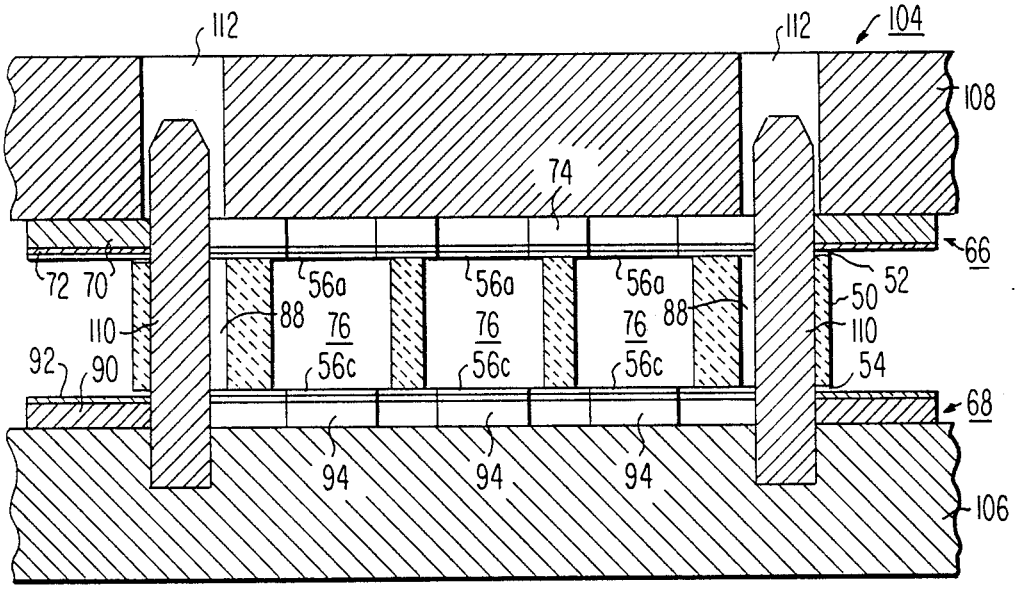
FIG. 8 is an enlarged front sectional view of a portion of the cathode-grid subassembly during its manufacture.

With reference to FIG. 8, a brazing jig 104 comprises lower and upper jig members 106 and 108, respectively. The second bimetal transition member 68 is positioned on the lower jig member 106 with the first metal layer 90 comprising nickel-iron in contact with the lower jig member. The ceramic member 50 is disposed on the second bimetal transition member 68 so that the second metallized patterns 56c on portions of the second major surface 54 of the ceramic member are in contact with the second metal layer 92 of the cathode assembly contact portions (not shown) of the second bimetal transition member. The first bimetal transition member 66 is disposed on the first major surface 52 of the ceramic member 50 so that the second metal layer 72 of the first and second contact portions 74 and 78 (only 74 is shown) is in contact with the metallizing patterns 56a and 56b, respectively (only pattern 56a is shown). The brazing alignment pins 110 fitted in the lower jig member 106 align the alignment channels 86 and 102 (shown in FIGS. 3 and 6, respectively) in the first and second bimetal transition members 66 and 68, with the alignment apertures 88 in the ceramic member 50. The upper jig member 108 is placed in contact with the first metal layer 70 of the first bimetal transition member 66. A pair of reference apertures 112 in the upper jig member 108 enclose the alignment pins 110.

The jig 104, loaded in the manner described herein, is then heated in a wet hydrogen atmosphere in a BTU three-zone belt furnace (not shown) at temperatures of 1105° C., 1120° C. and 1105° C. to melt the copper layers 72 and 92. The belt speed through the furnace is four inches per minute. Since the transition members 66 and 68 comprise substantially flat members having nickel-iron layers 70 and 92, each with a thickness not more than about 20% the thickness of the ceramic member 50, little or no stress is introduced into the ceramic member during the brazing operation.

Figure 5:
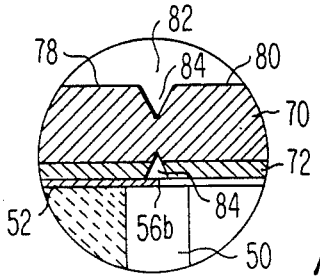
FIG. 5 is an enlarged view of the portion of the cathode-grid subassembly shown within the circle 5 of FIG. 4.

The fabrication of the cathode-grid subassembly 12 proceeds as follows. After the brazing of the first and second bimetal transition members 66 and 68 to the ceramic member 50, the removable frame portions 80 and 96, respectively, are removed at the weakened bridge regions 82 and 98. The removal of the frame portion 80 from the first transition member 66 electrically isolates the first electrode contact portions 74 from the second electrode contact portions 78. As shown in FIG. 5, the metallized pattern 56b, underlying the second electrode contact portion 78, terminates at the lower notch 84 of the weakened bridge portion 82. Thus, only the copper layer 72 to the left of the lower notch 84 in FIG. 5 is brazed to the metallized pattern 56b. Since there is no metallizing to the right of the lower notch 84, the copper layer 72 will not adhere to the ceramic member 50, and the frame portion 80 can be broken away readily. The frame portions 96 of the second bimetal transition member 68 are also broken away along the weakened bridge regions 98, thereby electrically isolating each of the cathode assembly contact portions 94 attached to the metallized patterns 56c on the second surface 54 of the ceramic member 50. The cathode contact leads 100, extending from selected ones of the portions 94, are bent at about a 90° angle, as shown in FIG. 2, to facilitate attachment thereto of stem leads (not shown). The cathode eyelets 40 are welded, e.g., by laser welding, to oppositely disposed pairs of the cathode assembly contact portions 94. The control grid electrode 18 is then disposed upon the first electrode contact portions 74 and aligned by means of secondary apertures (not shown) with the alignment apertures 88 in the ceramic member 50. Such a method of alignment is described in copending U.S. patent application Ser. No. 643,175, which is incorporated by reference herein for the purpose of disclosure. The flanges 58 of control grid electrode 18 are welded, e.g., by laser welding, to the first electrode contact portions 74. Next, the second apertures 64 of the screen grid electrode 20 are aligned, either directly or indirectly, with the first apertures in the control grid electrode 18. The parallel flanges 62 of the screen grid electrode 20 are welded, e.g., by laser welding, to the second electrode contact portions 78. The cathode sleeves 38 are inserted into the eyelets 40 and welded thereto. The heater coils 42 are located within the sleeves 38, and the heater legs 44 are welded to the heater straps 46. Preferably, the cathode assembly welds also are made by laser welding. Laser welding is preferred since no pressure is applied to physically distort the parts, and the welding parameters can be precisely controlled.

While the cathode-grid subassembly 12 described herein only has the control grid electrode 18 and the screen grid electrode 20 attached to electrical contact portions 74 and 78 of the transition member 66, it should be clear to one skilled in the art that the size of the ceramic member and the transition member brazed thereto can be increased to permit attachment thereto, e.g., of the first focusing electrode. Correspondingly, the transition member brazed to the second surface 54 of the ceramic may also be provided with tabs in addition to the cathode contact leads 100 to which heater supports for the heater straps 46 are attached.

The novel fabrication method is preferable to previous fabrication methods for the following reasons: precise alignment is not required to braze the transition members 66 and 68 to the metallized patterns; the control grid 18 and the screen grid 20 are laser welded to the electrical contact portions 74 and 78 without the distortion that occurs during high temperature brazing; the grids 18 and 20 can be individually aligned and spaced to provide greater alignment accuracy; the subassembly 12 can be inspected after each step to minimize the expense of manufacturing defective structures; and the use of the transition members with removable frame portions simplifies the manufacturing process, since it is easier to align unitized members than to separately align a plurality of discrete components.

What is claimed is:

1. In a multibeam electron gun for a cathode-ray tube comprising a plurality of cathode assemblies and at least two spaced successive electrodes having aligned apertures therethrough for passage of a plurality of electron beams, said cathode assemblies and said electrodes being individually held in position from a common ceramic member, said ceramic member having a first major surface and an oppositely disposed second major surface with a metallized pattern formed on at least a portion of each major surface, said electrodes being attached to said first major surface and said cathode assemblies being attached to said second major surface the improvement wherein a first transition member is attached to said metallized pattern on said first major surface of said ceramic member, said first transition member including stress reducing means, and at least one of said electrodes is attached to said transition member.

2. The gun defined in claim 1, wherein said first transition member includes at least one electrode contact portion and a removable frame portion connected to said electrode contact portion by at least one weakened bridge region.

3. The gun defined in claim 2, wherein said first transition member is disposed between said metallized pattern on said first major surface and two of said electrodes, whereby said electrodes are connected to the electrode contact portions of said transition member and electrically isolated from one another by the removal of said frame member at said weakened bridge region.

4. The gun defined in claim 1, wherein a second transition member is attached to said metallized pattern on said second major surface, said second transition member including stress reducing means, said second transition member being disposed between said metallized pattern and said cathode assemblies.

5. The gun defined in claim 4, wherein said second transition member includes a plurality of cathode assembly contact portions and removable frame portion connected to said cathode assembly contact portions by a plurality of weakened bridge regions, wherein each of said cathode assemblies are connected to a different one of said cathode assembly contact portions and electrically isolated from one another by the removal of said frame member at said plurality of weakened bridge regions.

6. The gun defined in claim 4, wherein the stress reducing means for said first transition member and said second transition member comprise substantially flat plates configured to conform to the metallized patterns formed on said first and said second major surfaces.

7. The gun defined in claim 6, wherein said first transition member and said second transition member comprise two layers of metal bonded face-to-face to form a bimetal, one layer of metal having a melting point lower than the other layer of metal layer.

8. The gun defined in claim 7, wherein said layer of metal having the lower melting point comprises copper.

9. The gun defined in claim 8, wherein the other layer of metal comprises a nickel-iron alloy of 42% nickel and 58% iron.

10. The gun defined in claim 9, wherein the stress reducing means further comprises the layer of nickel-iron alloy having a thickness of not more than about 20% of the thickness of said ceramic member.

* * * * *